US006481989B2

(12) United States Patent
Eiermann

(10) Patent No.: US 6,481,989 B2
(45) Date of Patent: Nov. 19, 2002

(54) TROCHOIDAL DESIGN ROTARY PISTON ENGINE AND METHOD OF MAKING SAME

(75) Inventor: Dankwart Eiermann, Weissenberg (DE)

(73) Assignee: Brandenburgische Forschungs-und Entwicklungsgesellschaft Cottbus mbH, Cottbus (DE)

( * ) Notice: Subject to any disclaimer, the term of this patent is extended or adjusted under 35 U.S.C. 154(b) by 0 days.

(21) Appl. No.: 09/866,466

(22) Filed: May 29, 2001

(65) Prior Publication Data

US 2002/0015650 A1 Feb. 7, 2002

(30) Foreign Application Priority Data

May 27, 2000 (DE) ..... 100 26 448

(51) Int. Cl.[7] ..... F01C 1/22; F01C 21/06; F01C 21/10

(52) U.S. Cl. ..... 418/61.2; 418/83

(58) Field of Search ..... 418/61.2, 83

(56) References Cited

U.S. PATENT DOCUMENTS

| | | | | |
|---|---|---|---|---|
| 3,280,802 A | * | 10/1966 | Froede | 418/83 |
| 3,298,330 A | * | 1/1967 | Ito et al. | 418/83 |
| 3,921,593 A | * | 11/1975 | Lamm | 418/83 |
| 3,942,917 A | * | 3/1976 | Wieland | 418/61.2 |
| 3,975,122 A | * | 8/1976 | Hackbarth et al. | 418/83 |
| 5,199,863 A | | 4/1993 | Eiermann | 418/61.2 |

* cited by examiner

*Primary Examiner*—John J. Vrablik
(74) *Attorney, Agent, or Firm*—Crowell & Moring LLP

(57) ABSTRACT

In a trochoidal design rotary piston engine, side disks are intended to be assembled from one cast side section and a cover disk, where the side section and the cover disks are used in a sealing function. The side section includes cast in reinforcing ribs on a side thereof facing away from the engine combustion chamber.

18 Claims, 2 Drawing Sheets

TROCHOIDAL DESIGN ROTARY PISTON ENGINE AND METHOD OF MAKING SAME

BACKGROUND OF THE INVENTION

This application claims the priority of German application 100 26 448.4, filed May 27, 2000, the disclosure of which is expressly incorporated by reference herein.

This invention refers to a trochoidal design rotary piston engine with a rotary housing, two side disks with a bearing-mounted eccentric shaft and a bearing-mounted rotary piston on the eccentric shaft.

In such rotary piston engine, as it is also known, for example, from the German Patent Document No. DE-C 40 03 663 (corresponding U.S. Pat. No. 5,199,863), the side parts are usually made as cast construction parts. Aluminum alloys are a well-known material used in order to reduce the weight of the engine. In the particularly highly stressed rotary piston engines of this design, fissures have occurred after extended running time, especially when supercharging has been undertaken. This formation of cracks can lead to a loss of the engine. The fissuring can be avoided when the strength of the material is increased. Such increase in the strength of the material, however, leads to an increase in engine weight.

An object for this invention was the accomplishment of the task of finding the most cost effective material to make side disks for the above-described type rotary piston engine, which could be produced at low cost to provide a high level of strength at low weight.

This object has been achieved according to preferred embodiments of the invention in that the side disk is manufactured from a sealed cover disk and a load bearing composite side part made as a cast unit with an engine combustion compartment defining wall, an external bearing rim, and an internal bearing support where the wall and the far side of the engine combustion compartment are reinforced with ribs.

A very high strength at low weight can be achieved by splitting of the side disk according to this invention. The component contours of the cast bearing construction unit are visible only on the side that is open to the side (of the contours). That makes the side part simple to cast, for example, in an aluminum die cast unit process.

In a profitable production of this invention, at least two approximately radial direction tensile ribs are intended to be arranged at an angular distance of about 90 degrees. These tensile ribs are arranged at the beginning and end of the thermally and mechanically most stressed rotary piston housing and present a good transfer of power from the bearing support to the entire side section.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
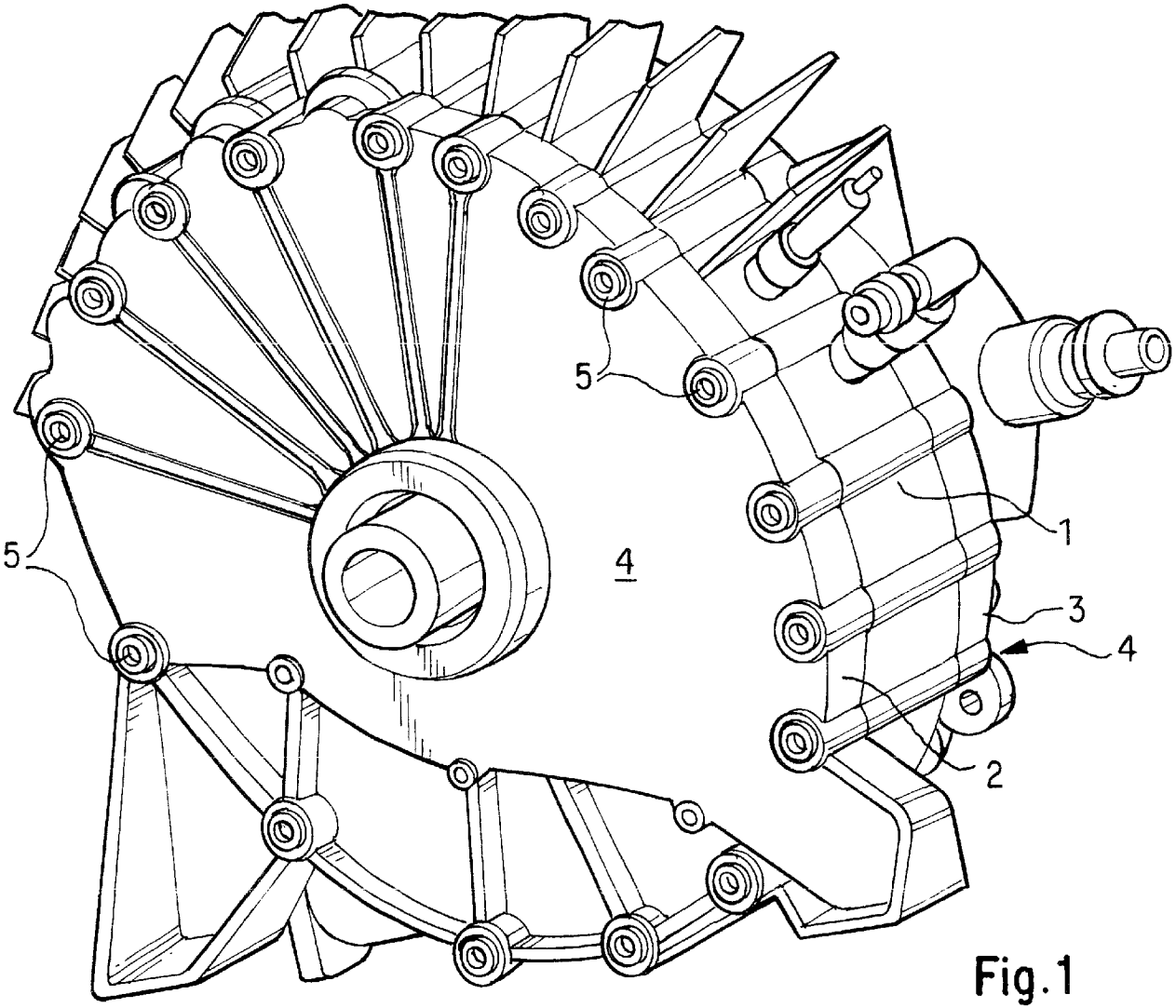
FIG. 1 shows a perspective view of a rotary piston engine equipped with side disks, constructed according to a preferred embodiment of the this invention.

The rotary piston engine represented in FIG. 1 is also a subject of parallel U.S. patent applications, Ser. Nos. 09/866,467 and 09/866,484, filed May 29, 2001 and claims the May 27, 2000 priority of the German patent applications 100 26 447.6 and 100 26 449.2. Therefore, additional information concerning the construction of the rotary piston engine can be found in these parallel patent applications.

The combined air and fluid cooled rotary piston engine has a rotary piston housing 1 and two side disks. Each of the side disks is composed of a side part 2, 3 and a disk cover 4. The rotary piston housing 1, the side components 2, 3, and the cover disks 4 are bolted together by axial tension ties.

Figure 2:
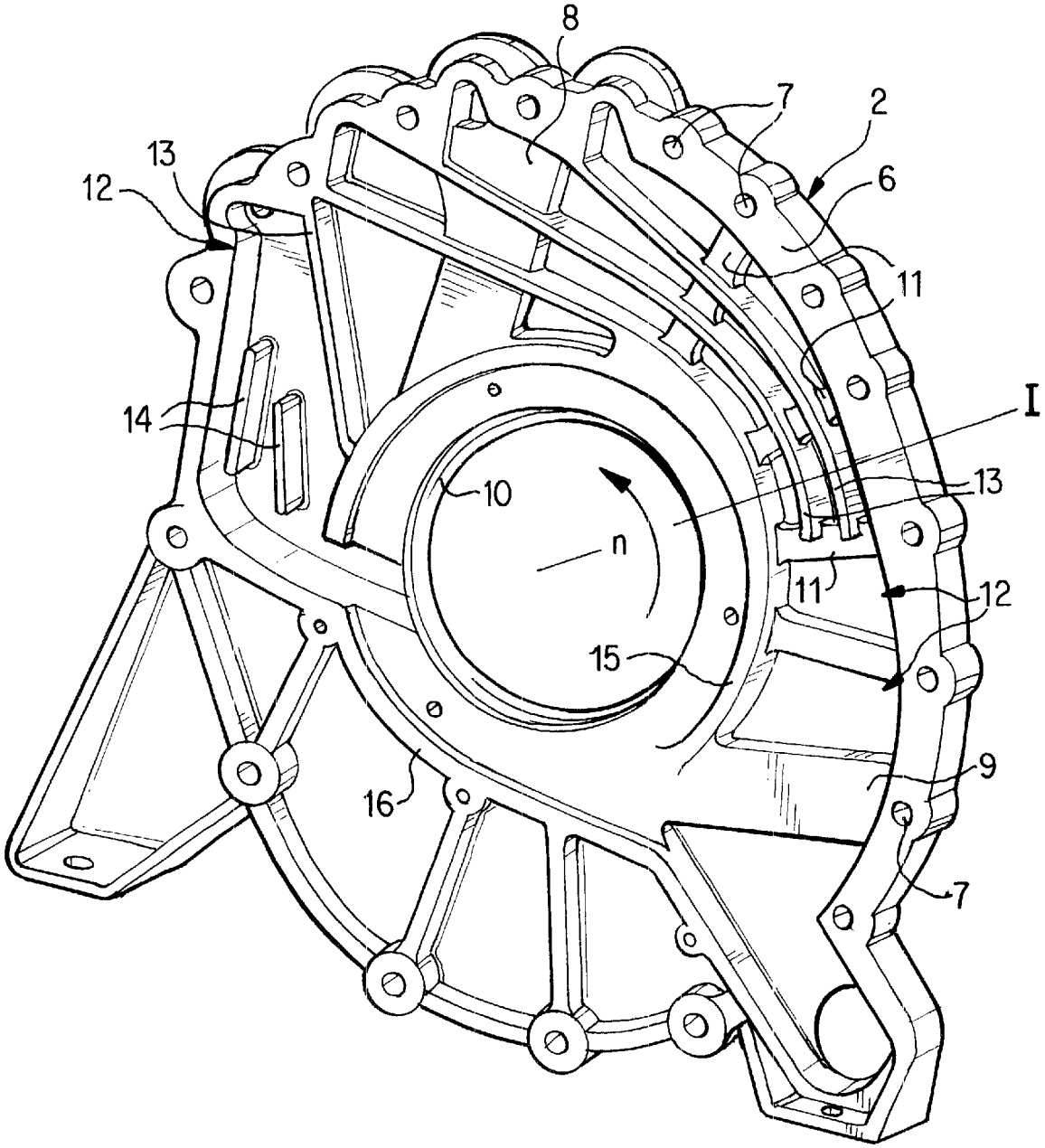
FIG. 2 shows a view of the side part without the cover disk.

FIG. 2 represents the side part 2. The side part 3 is essentially built mirror-symmetric to the side part 2 so that the following description applies basically to both side parts 2, 3.

The side part 2 is a cast construction component which, for example, is produced by a die cast process. The side part 2 has a radial wall facing the rotary piston housing 1 and is confined to the engine combustion compartment in which the rotary piston, not shown here, is rotating in the engine movement direction "n".

The external rim 6, which has bores 7 for the axial tension ties 5, projects on the external side from this radial wall in the axial direction. Additionally, there are connectors for a fluid-cooling unit in the area of the external rim.

The V-form tension ribs 8, 9 are arranged at an approximately 90 degree angle extending from the outside of the radial wall between the reinforced external rim 6 and a ring type bearing support 10, serving as the eccentric shaft seat. The tension rib 9 is arranged at an angular distance of about 30 degrees from the upper slack point of the rotary piston. The tension rib 8 is placed at an angular distance of about 60 degrees from the slack point so that the tension ribs 8, 9 are arranged at about 90 degrees to each other. As can be observed in FIG. 2, they are about tangential to the ring-form bearing support 10.

Intended to be located between the tension ribs 8 and 9 are several, basically also radial supplementary tension ribs 11, located between the external rim 6 and the bearing support 10 so that the wall of the intermediate areas represents a relatively low wall strength.

The bearing support is in an area, which is essentially located between the tension ribs 8, 9 and is provided with a rib 15 going around in a ring-form over about 270 degrees. Located between this rib 15 and the external rim, several additional ribs 13 are intended to start out at the external rim 6 and run tangentially in the direction of the rib 15 and then curve around it. Arranged in the rotating direction, in the area after the tension rib 8 in which there is an exhaust pipe opening, not shown here, in the rotary piston housing 1, are additional ribs 13 and 14. Stretched between the tension ribs 8, 9 and 11, in an area on the opposite side, is a rib 16 in form of a chord between the external rim 6.

The tension ribs 8, 9 and 11 have a lower strength in the axial direction than in the external rim 6 and the ribs 13, 14, 15, and 16, which all end at a common radial level. At the external rim 6 and the ribs 13, 14, 15, and 16, the cover disk 4 acts as a seal so that the ribs 13, 14, 15, and 16 form flow channels for a fluid coolant with the cover disk 4, especially for oil which is under a low pressure.

The side part represented in FIG. 2 can be single-form and, therefore, easily produced by casting, that is to say, without the use of casting cores.

The cover disk 4, which only has one sealing function, can be cast from synthetic materials or light metal in one piece. It is equally possible to make the cover disk from a sheet metal.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A side disk assembly for a rotary piston engine which has a rotary piston housing bounded axial ends of the housing by respective side disk assemblies to form a combustion chamber, said side disk assembly comprising:

a cover disk, and a bearing side section made as a cast part, wherein the bearing side section includes reinforcing ribs at a side thereof which in use faces the cover disk and away from the combustion space, wherein the bearing side section includes an external bearing rim and a centrally disposed bearing support for an engine shaft, and wherein the reinforcing ribs include at least two basic tension ribs, arranged in approximately radial direction and at an angular distance of about 90 degrees, at the immediate areas of the beginning and end of the thermally and mechanically most stressed portion of the housing said tension ribs being installed between the bearing support and the external bearing rim.

2. A side disk assembly according to claim 1, wherein the side section is equipped with reinforcement ribs between the bearing support and the external bearing rim, said reinforcement ribs extending in a direction of the perimeter and form cover disk cooling channels for the cover disk.

3. A side disk assembly according to claim 1, wherein the basic tension ribs extend approximately tangentially to the bearing support.

4. A side disk assembly according to claim 3, wherein supplemental tension ribs are provided for an area between the basic tension ribs, said supplemental tension ribs having a smaller cross section than the basic tension ribs.

5. A side disk assembly according to claim 3, wherein the side section is equipped with reinforcement ribs between the bearing support and the external bearing rim, said reinforcement ribs extending in a direction of the perimeter and form cover disk cooling channels for the cover disk.

6. A side disk assembly according to claim 1, wherein supplemental tension ribs are provided for an area between the basic tension ribs, said supplemental tension ribs having a smaller cross section than the basic tension ribs.

7. A side disk assembly according to claim 6, wherein the side section is equipped with reinforcement ribs between the bearing support and the external bearing ribs, said reinforcement ribs extending in a direction of the perimeter and form cover disk cooling channels for the cover disk.

8. A trochoidal design rotary piston engine with a rotary housing and two side disks, wherein each side disk comprises:

a sealed cover disk, and a bearing side section produced by a casting process, wherein each bearing side section has an engine combustion chamber defining wall, an external bearing rim and an internal bearing support, and wherein the engine combustion chamber is reinforced on a side of the bearing side section facing away from the combustion chamber by reinforcing ribs, wherein the reinforcing ribs include at least two basic tension ribs, arranged in approximately radial direction and at an angular distance of about 90 degrees at the immediate areas of the beginning and end of the thermally and mechanically most stressed portion of the housing, said tension ribs being installed between the bearing support and the external bearing rim.

9. The rotary piston engine according to claim 8, wherein the side section is equipped with reinforcement ribs between the bearing support and the external bearing rim, said reinforcement ribs extending in a direction of the perimeter and form cover disk cooling channels for the cover disk.

10. The rotary piston engine according to claim 8, wherein the basic tension ribs extend approximately tangentially to the bearing support.

11. The rotary piston engine according to claim 10, wherein supplemental tension ribs are provided for an area between the basic tension ribs, said supplemental tension ribs having a smaller cross section than the basic tension ribs.

12. The rotary piston engine according to claim 10, wherein the side section is equipped with reinforcement ribs between the bearing support and the external bearing rim, said reinforcement ribs extending in a direction of the perimeter and form cover disk cooling channels for the cover disk.

13. The rotary piston engine according to claim 8, wherein supplemental tension ribs are provided for an area between the basic tension ribs said supplemental tension ribs, having a smaller cross section than the basic tension ribs.

14. The rotary piston engine according to claim 13, wherein the side section is equipped with reinforcement ribs between the bearing support and the external bearing rim, said reinforcement ribs extending in a direction of the perimeter and form cover disk cooling channels for the cover disk.

15. A trochoidal design rotary piston engine comprising:

a housing; and first and second side disks between which the housing is disposed, the first side disk having a side part and a disk cover, the side part including an inner bearing support, an outer rim, a wall between the inner bearing support and the outer rim, wherein the wall of the side part partially defines an engine combustion space and has a thickness that is less than a thickness of the outer rim, wherein the disk cover is sealingly mounted to the side part, and wherein the disk cover, inner bearing support, and outer rim form a coolant chamber, and two basic tension ribs in the coolant chamber, wherein the basic tension ribs form an angle of approximately 90 degrees, at the immediate ateas of the thermally and mechanically most stressed portion of the housing and each basic tension rib has a thickness that is less than the thickness of the outer rim.

16. The rotary piston engine according to claim 15, wherein the basic tension ribs extend approximately tangentially to the bearing support.

17. The rotary piston engine according to claim 15, wherein the side part further comprises supplemental tension ribs in an area between the basic tension ribs, said supplemental tension ribs having a smaller cross section than the basic tension ribs.

18. The rotary piston engine according to claim 17, wherein the side part further comprises reinforcement ribs between the bearing support and the outer rim, said reinforcement ribs extending in a direction of the perimeter and form cover disk cooling channels for the cover disk.

* * * * *